US005865469A

United States Patent [19]

Chin

[11] Patent Number: 5,865,469

[45] Date of Patent: Feb. 2, 1999

[54] COVER FOLDER AND METHOD OF CONSTRUCTING THE SAME

[76] Inventor: Marybeth Chin, 609 13th St., Huntington Beach, Calif. 92648

[21] Appl. No.: 882,619

[22] Filed: Jun. 25, 1997

[51] Int. Cl.[6] ..... B42D 3/10; B42D 17/00; B42F 9/00; B42F 1/06

[52] U.S. Cl. ..... 281/45; 281/46; 281/48; 281/38; 281/21.1; 402/79; 402/80 R

[58] Field of Search ..... 281/45–49, 28–31, 281/34, 35, 15.1, 21.1, 51, 42, 23, 38; 402/45, 46, 74, 80 R, 17, 79; 412/34; 24/67.1–67.3

[56] References Cited

U.S. PATENT DOCUMENTS

| | | |
|---|---|---|
| 214,588 | 4/1879 | Russell . |
| 460,090 | 9/1891 | Fitzpatrick et al. . |
| 641,211 | 1/1900 | Lewthwaite . |
| 936,223 | 10/1909 | Dean . |
| 952,642 | 3/1910 | Robertson . |
| 990,262 | 4/1911 | Hedges . |
| 1,446,232 | 2/1923 | Wilburger . |
| 1,742,993 | 1/1930 | Jettinger . |
| 1,769,395 | 7/1930 | Selden . |
| 2,059,148 | 10/1936 | Schade . |
| 2,204,095 | 6/1940 | McLaren . |
| 2,349,947 | 5/1944 | Einzig . |
| 2,598,379 | 5/1952 | Hooe . |
| 2,599,768 | 6/1952 | Losch, Jr. . |
| 2,604,337 | 7/1952 | Taylor . |
| 3,135,531 | 6/1964 | Rankin . |
| 4,351,546 | 9/1982 | Cognata . |
| 4,402,530 | 9/1983 | Daguerre . |
| 4,486,032 | 12/1984 | Leahy . |
| 4,521,035 | 6/1985 | Berezowsky . |
| 4,575,123 | 3/1986 | Giblin et al. . |
| 4,682,792 | 7/1987 | Simmons . |
| 4,867,479 | 9/1989 | Mizutani . |
| 4,904,104 | 2/1990 | Gloeckle . |
| 4,934,738 | 6/1990 | Colonna . |
| 5,125,561 | 6/1992 | Idstein . |
| 5,226,676 | 7/1993 | Su . |

FOREIGN PATENT DOCUMENTS

| | | |
|---|---|---|
| 97/17210 | 5/1997 | WIPO . |

*Primary Examiner*—Frances Han
*Attorney, Agent, or Firm*—Kriegsman & Kriegsman

[57] ABSTRACT

A cover folder which includes a binding bar and a cover, the binding bar being slidably and removably mounted on the cover. The binding bar includes a pair of oppositely facing sidewalls which define the sides of an interior slot. Each sidewall includes an angled barb which projects out in a direction towards its opposing sidewall. The cover comprises a sheet folded over on itself to form a pair of panels having a common folded edge, the body of each of the pair of panels being separable from one another. A plurality of semicircular cutouts are formed on each panel. In use, the cover is inserted into the interior slot of the binding bar such that at least some of the cutouts on each panel engage the barbs so that the binding bar will not slip off the cover when the cover is opened to insert sheets or examine sheets already inserted.

20 Claims, 5 Drawing Sheets

COVER FOLDER AND METHOD OF CONSTRUCTING THE SAME

BACKGROUND OF THE INVENTION

The present invention relates generally to cover folders and more specifically to cover folders for securely holding and covering sheets of paper and a method of constructing the same.

Various kinds of cover folders are utilized to hold papers for business and school reports.

In a cover folder of a well-known type, a sheet of either plastic or paper is folded to form a pair of sheets having a common folded edge. The papers comprising the report are placed between the two sheets with the left side edge of the papers arranged adjacent and parallel to the common folded edge. An elongated plastic or metal binding bar is slid onto the outside of the common folded edge of the cover sheet. Such binders binding bars generally include two elongated panels that are joined along a common edge, the elongated panels forming a narrow opening opposite the common edge through which the cover sheet and the enclosed papers may be inserted. The elongated panels of the binder binding bar resiliently press and hold the opposing leafs of the cover sheet and the enclosed papers together.

A major drawback prevalent in many prior art cover folders of the type described above is that because the binding bar can be readily removed by sliding it either parallel to or at an angle relative to the folded edge. Very often, when the cover sheet is opened and separated, even with only small force, the binding bar tends to move perpendicularly relative to the folded edge. Because there generally is insufficient friction between the binding bar and the cover sheet to keep the binding bar mounted on the common folded edge of the cover sheet, the binding bar may separate from the cover sheet, particularly as the number of pages of the report increases. As a result, the enclosed papers are no longer held together and may become soiled or disorganized if they fall out of the cover sheet.

Due to the relative ineffectiveness of such cover folders, an adhesive or other binding element has often been used in the art to ensure secure engagement. In addition, some report covers comprising a binding bar and a cover have been provided with auxiliary clips or fasteners which must be inserted through the binding bar, the cover, and the sheets of paper held therein. The binding bar may, in any event, be retained to provide additional holding force or to improve the outer appearance of the report cover. The use of auxiliary components for holding the report papers together can result in the need to locate the edges of the pages at a distance away from the folded edge. Accordingly, the overall width of the cover must be increased to provide proper coverage for papers of standard size.

The use of additional clips, fasteners, supports, staples and the provision of additional cover area to properly accommodate the papers necessarily increases the overall cost of the report cover. Also the use of additional fasteners makes it more difficult and time consuming for the user to insert and remove the sheets. Moreover, certain types of report documents may not have sufficient margins for providing holes for the passage of fasteners. Also, it may otherwise be undesirable to form holes in the report pages in order to accommodate the fasteners. Holes are undesirable because, among other things, sheets secured by holes tend to tear during normal handling, and aesthetically, the appearance of such documents are greatly detracted.

As a result, attempts have been made in the art to construct cover folders which do not require an adhesive or other binding element to ensure secure engagement. An example of such a cover folder is disclosed in U.S. Pat. No. 4,486,032 to Leahy, which issued on Dec. 4, 1984. In this patent, there is disclosed a cover folder having a binder that securely retains the cover and inserted sheets, without the use of external fasteners. The cover is formed from a sheet which is folded once and then folded again to form the overlapping flap formed on the cover sheet. The binder is an elongated bar with an interior channel for receiving and holding a folded cover. The bar includes within the channel slanted ribs which engage the folded edge of the cover sheet along an overlapping flap. The overlapping flap of the cover sheet may be made more rigid by heat treatment and/or by a reinforcing coating.

Another report cover is disclosed in U.S. Pat. No. 4,575,123 to Giblin et al, which issued on Mar. 11, 1986. In this patent, a folded report cover is provided with a lock strip extending along at least one side of the cover parallel and contiguous to the fold and outwardly of the plane of the side. A channel-shaped gripping member is engaged to the cover along the fold and locked in place by a stop which extends from the interior of one leg of the gripping member into resilient engagement with a longitudinal edge of the lock strip and the one side of the cover. The other leg of the gripping member engages the opposite side of the cover. The lock strip is preferably an integral portion of the material of the cover.

Other examples include U.S. Pat. No. 5,226,676 to K. J. Su, U.S. Pat. No. 4,934,738 to R. Colonna, U.S. Pat. No. 4,904,104 to F. Gloeckle, U.S. Pat. No. 4,867,479 to S. Mizutani, U.S. Pat. No. 4,682,792 to G. Simmons, U.S. Pat. No. 4,521,035 to J. W. Berezowsky, U.S. Pat. No. 4,402,530 to G. Daguerre, U.S. Pat. No. 4,351,546 to C. Cognata, U.S. Pat. No. 2,349,947 to H. Einzig, U.S. Pat. No. 990,262 to G. H. Hedges, and U.S. Pat. No. 936,223 to J. N. Dean.

SUMMARY OF THE INVENTION

It is an object of the present invention to provide a new and improved cover folder and method of constructing the same.

It is another object of the present invention to provide a cover folder and a method of constructing the same in which the cover folder includes a cover which is securely held in a binding bar without the use of external fastening devices.

It is yet another object of the present invention to provide a cover folder and a method of constructing the same in which the cover folder includes a cover and a binding bar wherein the binding bar securely holds the cover and inserted sheets even when the cover is opened.

It is still another object of the present invention to provide a cover folder and a method of constructing the same in which the cover folder includes a binding bar and a cover wherein the cover is readily insertable and removable from the binding bar.

It is a further object of the present invention to provide a cover folder which may be mass produced, has a minimal number of parts, and can be easily assembled.

Accordingly, there is provided a cover folder which includes a binding bar and a cover, the binding bar comprising a pair of oppositely facing sidewalls which extend out to form an interior slot, the sidewalls terminating at a slit, one of the sidewalls being formed to include a locking member which projects out in a direction towards its opposing sidewall, the cover being slidably and removably mounted in the binding bar, the cover comprising a sheet folded to form a pair of panels having a common folded edge, the body of each of the pair of panels being separable from one another, a cutout being formed in one of the panels, the cutout protruding out in a direction away from both panels, wherein the locking member and cutout are located such that when the cover is inserted into the interior slot of the binding bar the cutout engages the locking member to prevent the binding bar from slipping off the cover.

There is also provided a method of constructing a cover folder comprising the steps of providing a sheet of plastic, folding the sheet of plastic along a common folded edge to form a cover having pair of panels, the body of each of the pair of panels being separable from one another, forming at least one cutout on one of the pair of panels, and providing a binding bar, the binding bar having a pair of oppositely facing sidewalls which extend out to form an interior slot, one of the sidewalls being formed to include a locking member which projects out in a direction towards its opposing sidewall, wherein when the binding bar is slidably mounted over the common folded edge of the cover the cutout will engage the locking member in such a manner that the binding bar can only be removed from the cover by sliding the binding bar off said cover in a direction parallel to the common folded edge.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration a specific embodiment for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate an embodiment of the invention and, together with the description, serve to explain the principles of the invention. In the drawings wherein like reference numerals represent like parts.

DETAILED DESCRIPTION OF A PREFERRED EMBODIMENT

Figure 1:
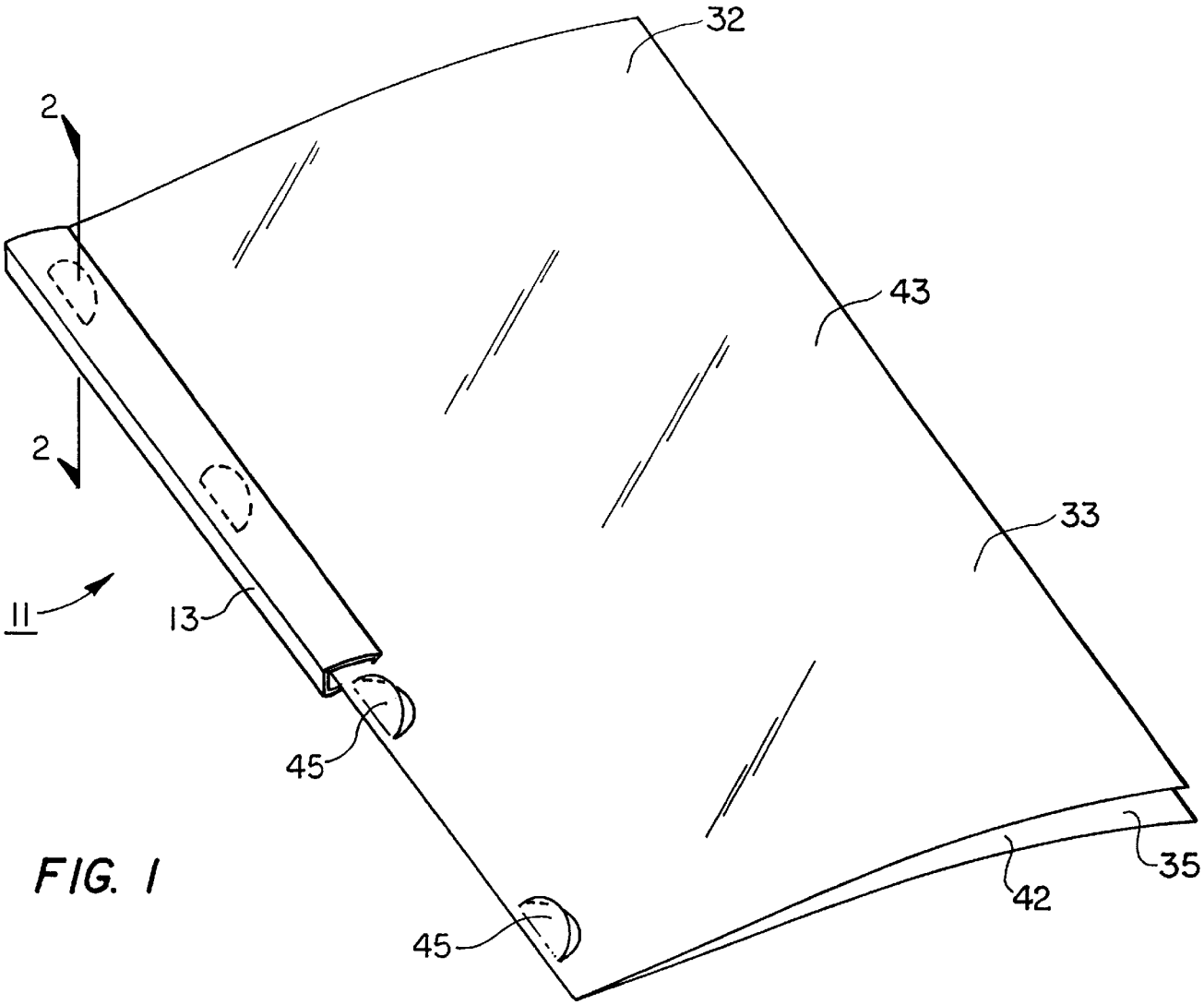
FIG. 1 is a perspective view of a cover folder constructed according to the teachings of the present invention, a portion of cover folder being broken away.
Figure 2:
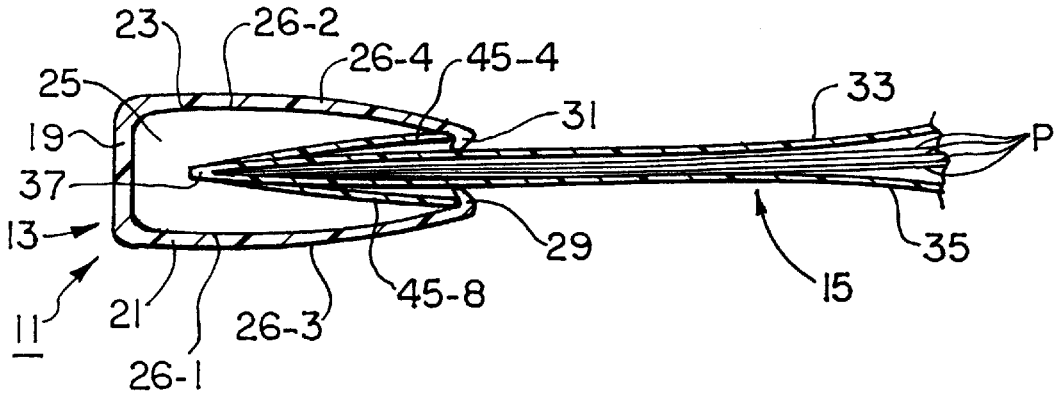
FIG. 2 is a section view taken along lines 2—2 in FIG. 1 of the cover folder shown in FIG. 1, the cover folder being shown with papers inserted therein.
Figure 5:
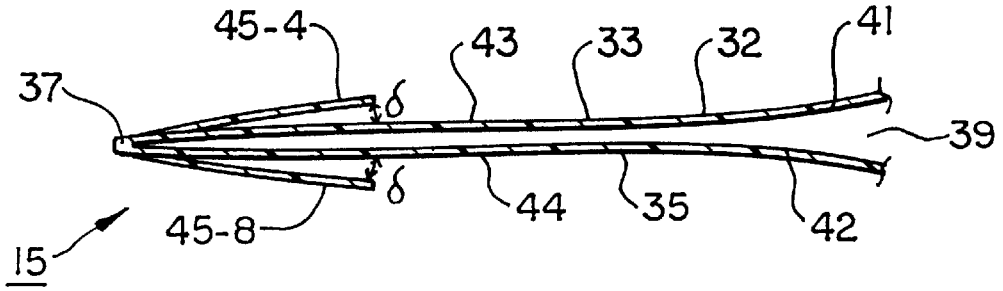
FIG. 5 is a section view, taken along lines 5—5 in FIG. 3, of the cover shown in FIG. 3.

Referring now to the drawings, there is shown in FIG. 1 a cover folder constructed according to the teachings of the present invention, the cover folder being represented generally by reference numeral 11. A section view of cover folder 11 with papers held therein is shown in FIG. 2. Those aspects of cover folder 11 not pertinent to the present invention are neither described nor shown herein.

Figure 3:
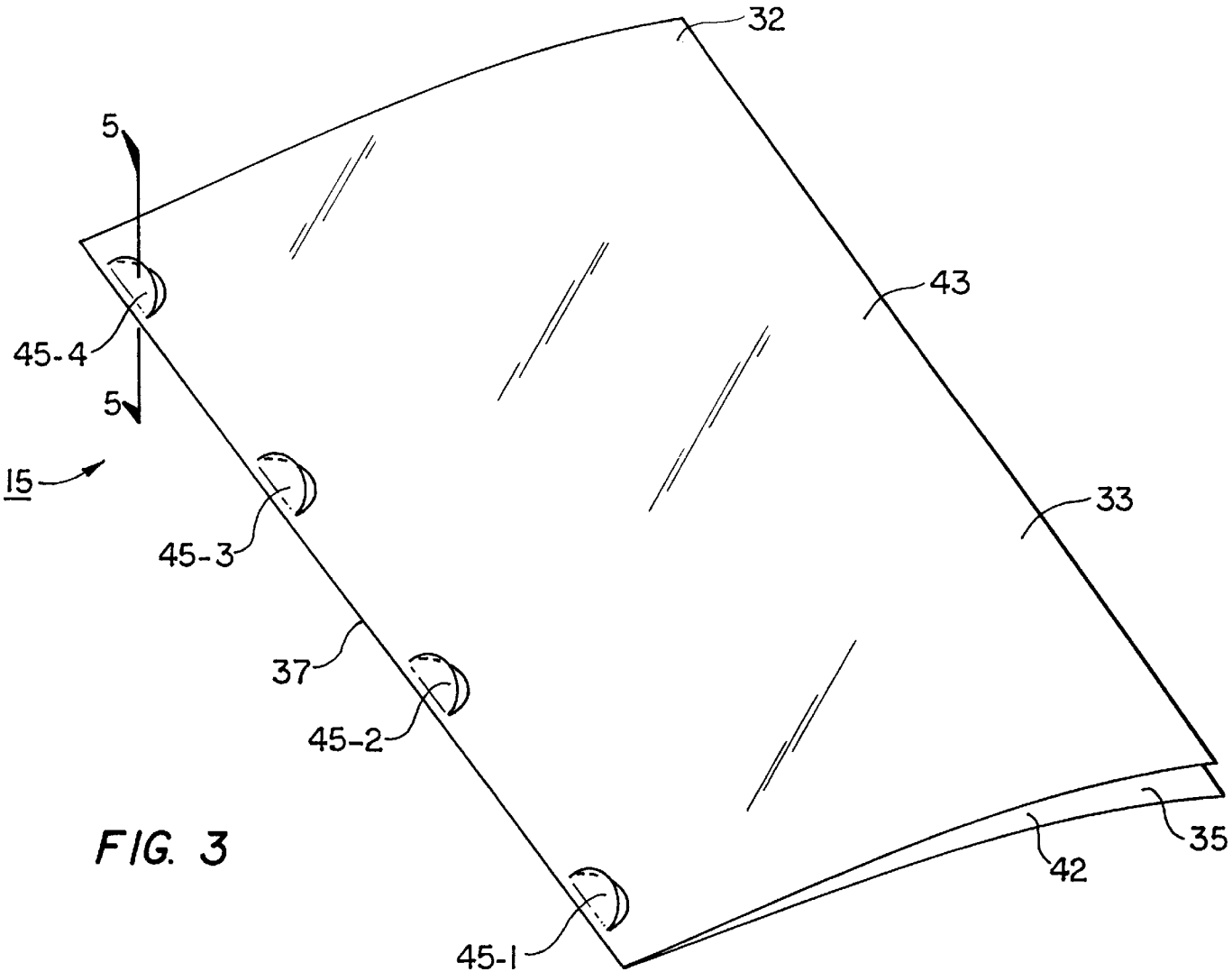
FIG. 3 is a perspective view of the cover on the cover folder shown in FIG. 1.
Figure 4:
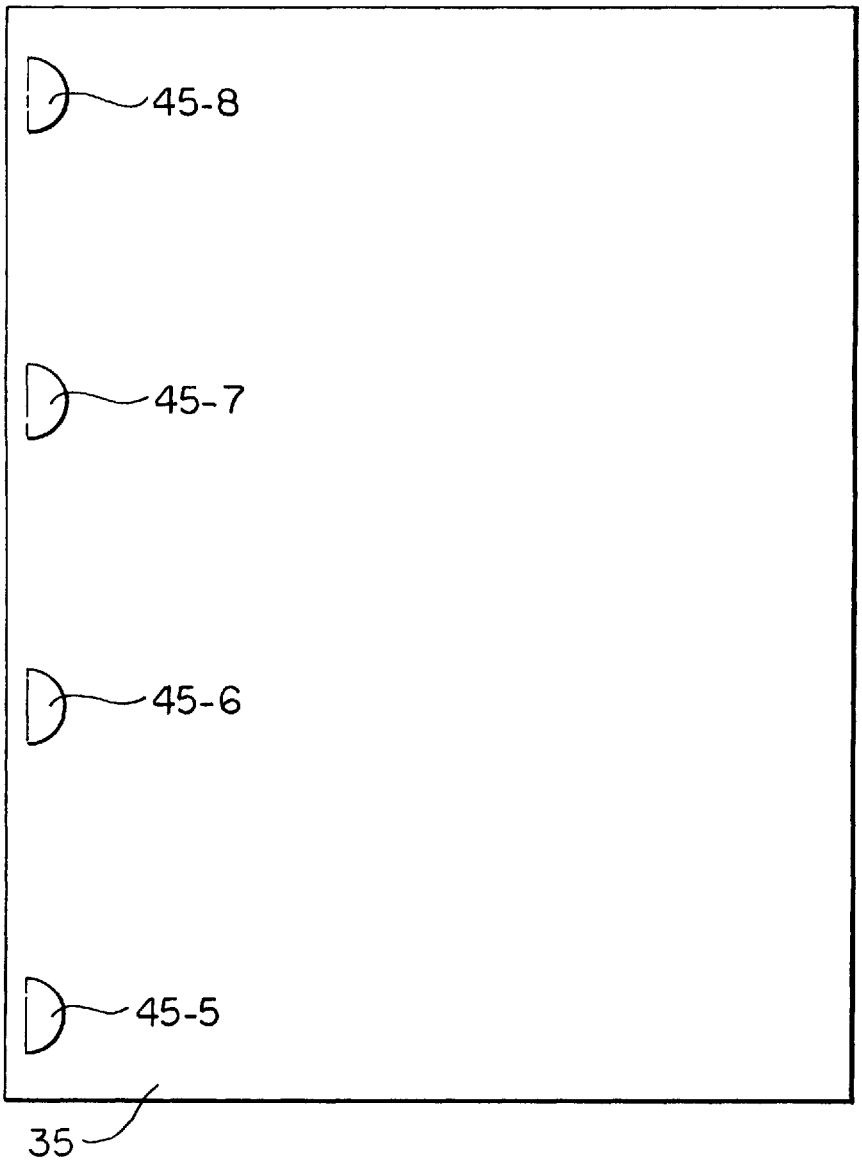
FIG. 4 is a plan view from the rear of the cover in FIG. 3.
Figures 6, 7:
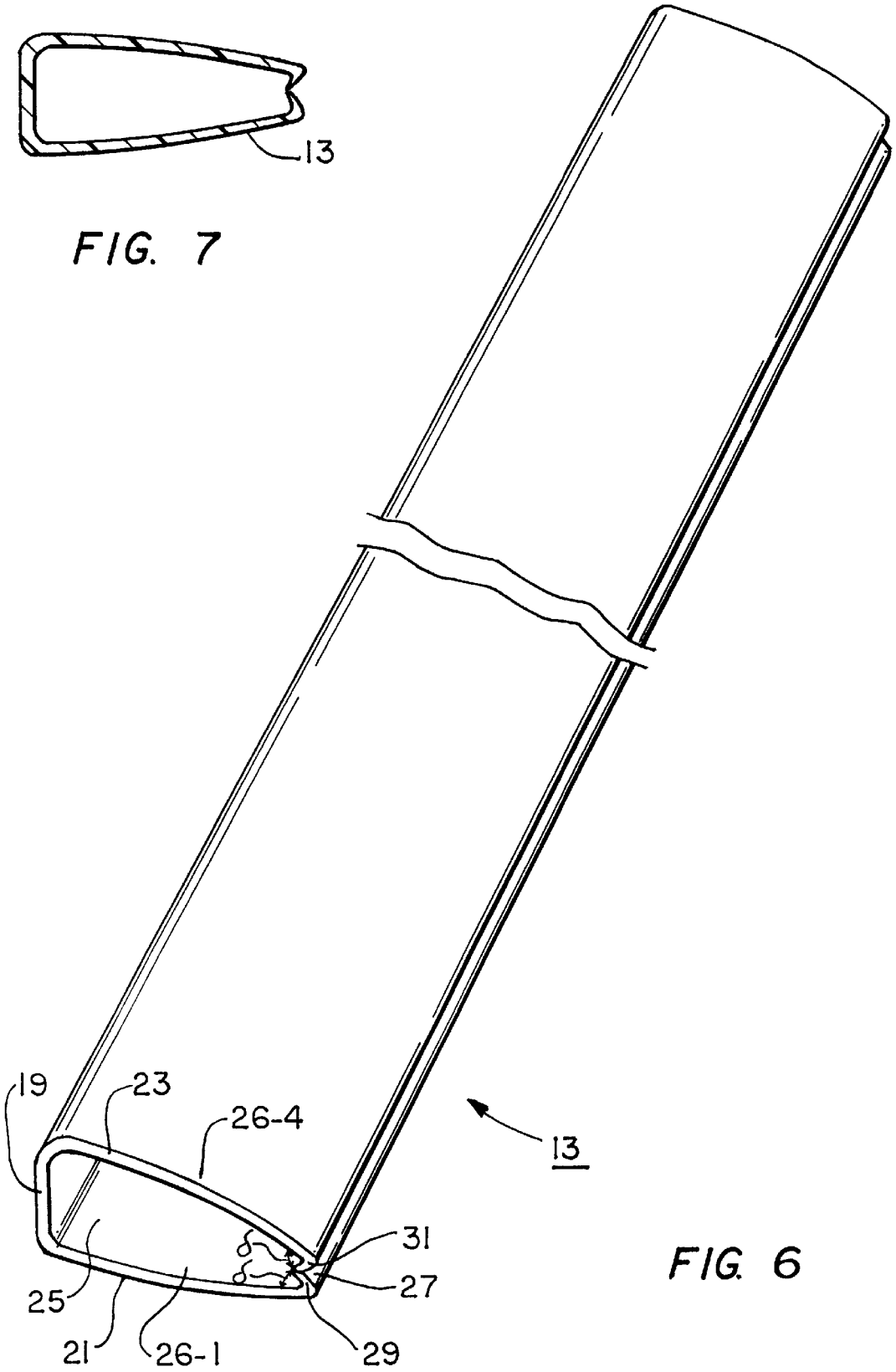
FIG. 6 is a perspective view of the binding bar in the cover folder shown in FIG. 1.
FIG. 7 is an end view of the binding bar shown in FIG. 6.

Cover folder 11 is comprised of a binding bar 13, see also FIGS. 6 and 7, and a cover 15, see also FIGS. 3 and 4, cover 15 being slidably and removably mounted within binding bar 13.

As can be seen, binding bar 13 is an elongated channel shaped member composed of a thermoplastic material suitable for use in a one step extrusion, such as polystyrene, polypropylene, polyvinylchloride, or nylon and includes a back wall 19 and a pair of oppositely facing sidewalls 21 and 23 which extend out from back wall 19 to define an interior slot 25. Sidewalls 21 and 23 each include an interior side 26-1 and 26-2, respectively, an exterior side 26-3 and 26-4, respectively, and converge so as to define a slit 27 along its length at its free end opposite back wall 19. Sidewalls 21 and 23 are angled relative to each other so as to resiliently press and hold cover 15 and enclosed papers P together.

The ends of sidewalls 21 and 23 are shaped to define barbs 29 and 31 which protrude into slot 25, respectively, away from slit 27. Barbs 29 and 31 face each other in slanted arrangement so that an acute angle y is formed between the intersection of barbs 29 and 31 with sidewalls 21 and 23, respectively, measured on the side farthest away from slit 27. Instead of being at the ends of sidewalls 21 and 23, the barbs could, if desired be spaced inward from the ends of sidewalls 21 and 23.

Cover 15, which is slidably and removably mounted within binding bar 13, comprises a single sheet 32 of a transparent plastic, such as polyvinylchloride, polystyrene, or polypropylene. Sheet 32 is dead folded in the middle, such as through the application of heat, to form a top panel 33 and a bottom panel 35, panels 33 and 35 including a common folded edge 37 and an opening 39 at its opposite edge. Although the body of panels 33 and 35 are separable from one another, the dead fold through common folded edge 37 causes sheet 32 to remain in a folded position. Panels 33 and 35 include an interior side 41 and 42, respectively, and an exterior side 43 and 44, respectively.

Cover 15 is constructed to include a plurality of cutouts which are in the shape of generally semicircular tabs or tongues. Using conventional die cutting techniques, cutouts 45 are punched through top panel 33 and bottom panel 35 after sheet 32 has been folded. The cutouts in top panel 33 are identified by reference numerals 45-1 through 45-4 while the cutouts in bottom panel 35 are identified by reference numerals 45-5 through 45-8. Cutouts 45 are formed in top and bottom panels 33 and 35 along common folded edge 37, cutouts 45 being formed approximately 1/16 of an inch from common folded edge 37. Even though sheet 32 is dead folded through common folded edge 37, plastic sheet 32 has memory of its previous open position. The memory of sheet 32 creates a build-up of tension along common folded edge 37 to open up sheet 32. As a consequence, when cutouts 45 are formed along common folded edge 37, cutouts 45 will relieve the tension in the area by springing out from exterior sides 43 and 44 of panels 33 and 35, respectively.

As shown in FIG. 2, cutouts 45-4 and 45-8 protrude out from exterior sides 43 and 44 of panels 33 and 35, respectively, in a direction away from common folded edge 37. Cutouts 45 form an acute angle δ at its intersection with the exterior side of its associated panel. As such, cutouts 45 are positioned on panels 33 and 35 so that when binding bar 13 is slid onto cover 15 over common folded edge 37, cutouts 45 on panel 33 extend up between sidewall 23 and slanted barb 31 and cutouts 45 on panel 35 extend up between sidewall 21 and slanted barb 29. The engagement of cutouts 45 with barbs 29 and 31 serves to effectively lock cover 15 in slot 25, thereby preventing the movement of binding bar 13 relative to cover 15 along a path perpendicular to common folded edge 37. Cover 15 and papers P are held securely within binding bar 13 by the engagement of cutouts 45 with slanted barbs 29 and 31 so that cover 15 and papers P will not slip out of binding bar 13 when cover 15 is opened. Cover 15 and papers P can only be removed by sliding binding bar 13 off cover 15 in a direction parallel to common folded edge 37.

Cover folder 11 may be made by folding a sheet of plastic over on itself to form a pair of panels and then punching cutouts on both panels and extruding a binding bar having barbs as described.

It should be noted that although cover 15 is shown with four cutouts 45 punched through both top panel 33 and bottom panel 35, cover 15 is not limited to that particular number of cutouts but rather could be constructed to include a greater or lesser amount of cutouts. Cover 15 also does not necessarily need to have the same number of cutouts formed on top panel 33 and bottom panel 35. For example, cover 15 could be constructed with as few as a single cutout formed on either the top panel or the bottom panel without losing its utility.

It should also be noted that although cover 15 is shown with cutouts 45 which are semicircular in shape, cover 15 is not limited to that particular shape for the cutouts. Rather, the cutouts could be formed in any shape that would suitably engage barbs 29 and 31 when binding bar 13 is slid onto cover 15. For example, the cutouts could be rectangularly or triangularly shaped without departing from the spirit of the present invention.

Cover folder 11 may be used in the following manner. Binding bar 13 is slid off of cover 15 along the length of common folded edge 37, if not already separated. Papers P are then inserted through opening 39 between panels 33 and 35 so that the left side edge of papers P is arranged adjacent and parallel to common folded edge 37, panels 33 and 35 serving to protect and aesthetically improve the overall condition of papers P contained therewithin. Then, binding bar 13 is slid onto cover 15 and papers P over common folded edge 37 of panels 33 and 35 in a direction parallel to folded edge 37. Positioned as such, binding bar 13 resiliently presses and holds cover 15 and papers P together in place. Cutouts 45 on panel 33 extend up between sidewall 23 and slanted barb 31 and cutouts 45 on panel 35 extend up between sidewall 21 and slanted barb 29. The engagement of cutouts 45 with barbs 29 and 31 serves to effectively lock cover 15 in slot 25, thereby preventing binding bar 13 from being pulled off of cover 15 in any direction which is not parallel to common folded edge 37.

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A cover folder comprising:

a) a binding bar, said binding bar having a pair of oppositely facing sidewalls which define the sides of an interior slot, one of the sidewalls having a locking member which projects out in a direction towards its opposing sidewall; and b) a cover, said cover being slidably and removably mounted in said binding bar, said cover comprising a sheet folded to form a pair of panels having a common folded edge, the body of each of the pair of panels being separable from one another, a cutout formed in one of the panels;

c) wherein the locking member and the cutout are located such that when said cover is inserted into the interior slot of said binding bar, the cutout will engage the locking member and prevent said binding bar from slipping off said cover.

2. The cover folder as claimed in claim 1 wherein said cover is made of plastic and wherein the cutout engages the locking member in such a manner that said binding bar can only be removed from said cover by sliding said binding bar off said cover in a direction parallel to the common folded edge.

3. The cover folder as claimed in claim 2 wherein said sidewalls of said cover converge at a slit.

4. The cover folder as claimed in claim 3 wherein the cutout is formed close to the common folded edge.

5. The cover folder as claimed in claim 4 wherein the cutout is generally semicircular in shape.

6. The cover folder as claimed in claim 5 wherein the locking member is in the form of a barb.

7. The cover folder as claimed in claim 6 wherein said cover is inserted into the interior slot of said binding bar so that the cutout extends up into the area between the member and the sidewall from which the member protrudes.

8. The cover folder as claimed in claim 7 wherein the cutout is approximately 1/16 of an inch from the common folded edge.

9. The cover folder as claimed in claim 8 wherein the barb extends out from the end of its associated sidewall.

10. A cover folder comprising:

a) a binding bar comprising a pair of oppositely facing sidewalls which define the sides of an interior slot, each sidewall is formed to include a locking member which projects out in a direction towards its opposing sidewall; and b) a cover, said cover being slidably and removably mounted in said binding bar, said cover comprising a sheet folded to form a pair of panels having a common folded edge, the body of each of the pair of panels being separable from one another, at least one cutout formed in each of the panels, each cutout protruding out in a direction away from both panels;

c) wherein said cutouts and locking members are located such that when said cover is inserted into the interior slot of said binding bar at least some of the locking members engage at least some of the cutouts to prevent said binding bar from slipping off said cover.

11. The cover folder as claimed in claim 10 wherein said cover is made of plastic.

12. The cover folder as claimed in claim 11 wherein said cover is made of a stiff plastic.

13. The cover folder as claimed in claim 12 wherein each cutout is close to the common folded edge of the panels.

14. The cover folder as claimed in claim 13 wherein the cutouts are generally semicircular in shape.

15. The cover folder as claimed in claim 14 wherein the cover is made of polypropylene.

16. The cover folder as claimed in claim 15 wherein said cover is inserted into the interior slot of said binding bar so that at least one cutout on each panel extends up into the area between its associated locking member and the sidewall from which the locking member protrudes.

17. A method of constructing a cover folder comprising the steps of:

a) providing a sheet of plastic;

b) folding said sheet of plastic along a common folded edge to form a cover having pair of panels, the body of each of the pair of panels being separable from one another;

c) forming at least one cutout on one of the panels; and d) providing a binding bar having a pair of oppositely facing sidewalls which define the sides of an interior slot, one of the sidewalls formed to include a locking member which projects out in a direction towards its opposing sidewall;

e) wherein the binding bar is slidably mounted over the common folded edge of the cover so that the cutout engages the locking member in such a manner that the binding bar can only be removed from said cover by sliding the binding bar off said cover in a direction parallel to the common folded edge.

18. A method of constructing a cover folder comprising the steps of:

a) providing a sheet of plastic;

b) folding a sheet of plastic along a common folded edge to form a cover having a pair of panels, the body of each of the pair of panels being separable from one another;

c) forming at least one cutout on each of the pair of panels, the at least one cutout on each panel protruding out in a direction away from both panels; and d) providing a binding bar having a backwall and a pair of oppositely facing sidewalls which extend out from the backwall to form an interior slot, each sidewall having a locking member which projects out in a direction towards its opposing sidewall;

e) wherein the binding bar is slidably mounted over the common folded edge of the cover so that the cutout on each panel engages an associated member in such a manner that said binding bar can only be removed from said cover by sliding said binding bar off said cover in a direction parallel to the common folded edge.

19. The method of constructing a cover folder as claimed in claim 18 wherein the step of forming at least one cutout on each of the pair of panels is accomplished by punching at least one cutout through both panels of the cover.

20. A cover folder for holding sheets, the cover folder comprising:

a) a cover for holding inserted sheets, the cover having a cutout; and b) a binding bar for securely retaining said cover and the inserted sheet, said binding bar including a barb;

c) the cutout being located on said cover and the barb being located on said binding bar such that when the binding bar is mounted onto said cover, the barb will engage the cutout and prevent said binding bar from slipping off said cover.

* * * * *